US006877886B2

(12) United States Patent
Schuster et al.

(10) Patent No.: US 6,877,886 B2
(45) Date of Patent: Apr. 12, 2005

(54) LANDSCAPE LIGHTPOST

(75) Inventors: Jack Schuster, Mound, MN (US); Daniel Brooks, Bloomington, MN (US)

(73) Assignee: Engineered Products Co., Plymouth, MN (US)

( * ) Notice: Subject to any disclaimer, the term of this patent is extended or adjusted under 35 U.S.C. 154(b) by 167 days.

(21) Appl. No.: 10/413,677

(22) Filed: Apr. 15, 2003

(65) Prior Publication Data

US 2003/0198056 A1 Oct. 23, 2003

Related U.S. Application Data

(60) Provisional application No. 60/374,924, filed on Apr. 22, 2002.

(51) Int. Cl.[7] ..... F21S 13/10

(52) U.S. Cl. ..... 362/431; 362/368; 362/375; 362/414; 174/38; 174/62; 248/545

(58) Field of Search ..... 362/154, 253, 362/362, 368, 370, 374, 375, 382, 391, 410, 414, 431, 152, 153; 174/37–39, 50, 52.1, 61, 62–64, 544, 545, 65 R; 248/545

(56) References Cited

U.S. PATENT DOCUMENTS

| | | | | | |
|---|---|---|---|---|---|
| 3,162,718 | A | * | 12/1964 | Gunthel, Jr. | 174/38 |
| 3,652,779 | A | * | 3/1972 | Grinols | 174/38 |
| 3,812,279 | A | * | 5/1974 | Voegeli | 174/38 |
| 3,868,474 | A | * | 2/1975 | Bunten | 174/38 |
| 4,787,018 | A | * | 11/1988 | Poyer | 362/431 |
| 4,858,877 | A | * | 8/1989 | Carter | 248/545 |
| 5,414,607 | A | * | 5/1995 | Harris et al. | 362/431 |
| 5,586,742 | A | * | 12/1996 | Carter | 248/545 |
| D430,942 | S | | 9/2000 | Schuster | |
| 6,198,041 | B1 | * | 3/2001 | Leschinger et al. | 174/38 |

OTHER PUBLICATIONS

*Landscape Lighting*, Crescent Stonco, Jul. 3, 2000, http://www.stonco.com/products/landscap/index.htm, The Genlyte Group, Inc.

*Gard–N–Post*, Arlington Industries, Inc., Feb. 22, 2002, http://www.aifittings.com/whnew33.htm.

* cited by examiner

*Primary Examiner*—John Anthony Ward
*Assistant Examiner*—Ismael Negron
(74) *Attorney, Agent, or Firm*—Patterson, Thuente, Skaar & Christensen, P.A.

(57) ABSTRACT

A landscape lightpost that provides a substantially enclosed wire compartment. The lightpost includes a main post, a cap, a separator plate, and structure for positioning the separator plate between the main post and cap, to form the substantially enclosed wire compartment.

43 Claims, 6 Drawing Sheets

Fig. 8
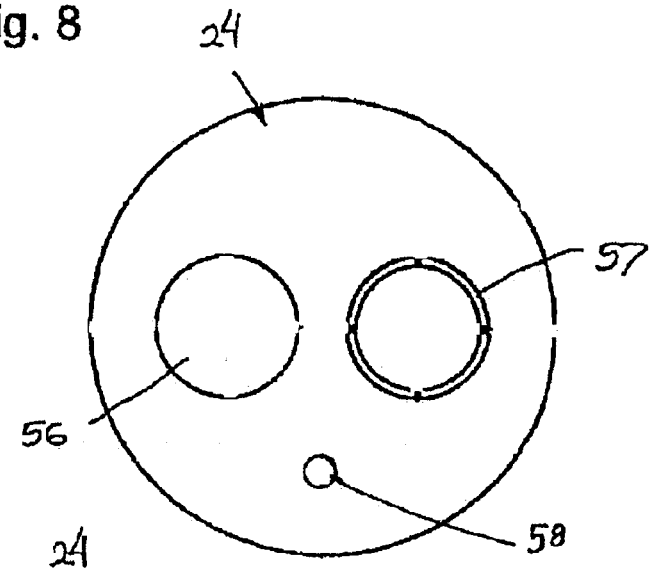
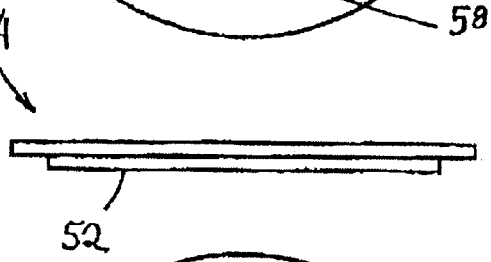
Fig. 9
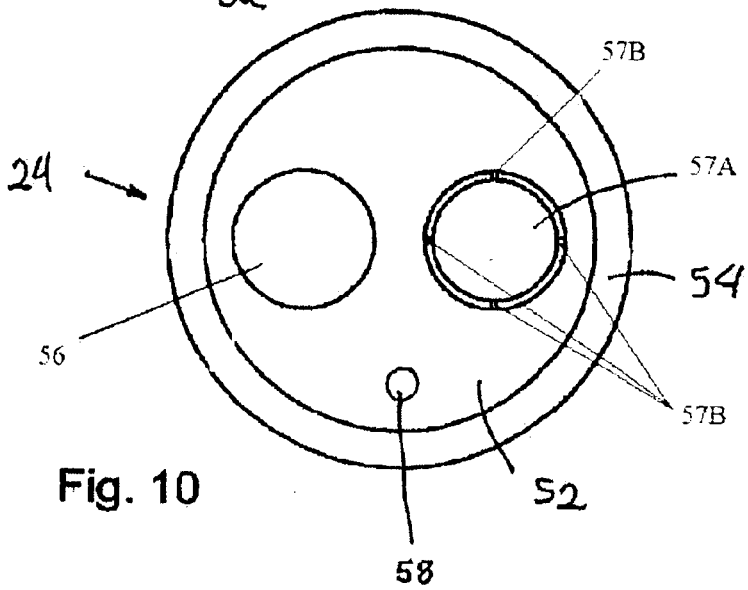
Fig. 10

Fig. 11
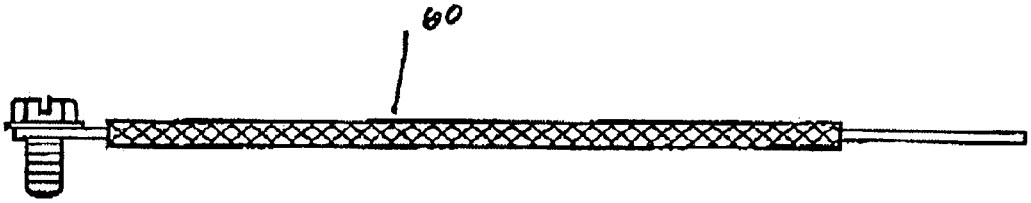
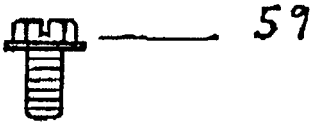
Fig. 12

LANDSCAPE LIGHTPOST

RELATED APPLICATION

The present application claims the benefit of U.S. Provisional Application No. 60/374,924 filed Apr. 22, 2002, which is incorporated herein in its entirety by reference.

FIELD OF THE INVENTION

The present invention relates generally to architectural landscape products. More, particularly, the present invention relates to a landscape lightpost that includes a substantially enclosed wire compartment.

BACKGROUND OF THE INVENTION

In many locations, it is desirable to provide lighting for either safety or aesthetic concerns. One particularly popular way of providing lighting is through a series of lights that are mounted above a ground surface adjacent to a walkway or drive way.

These types of lights are typically mounted to a post that is partially buried in a ground surface. The post thereby provides a stable support for the lights. The post also provides a means to discretely feed wires used to power the lights into the light fixture.

Carter, U.S. Pat. Nos. 4,858,877 and 5,586,742, each disclose a lightpost for supporting a light fixture. The Carter lightposts each include a main post, a cap and a mounting structure.

Another design for a landscape lightpost is set forth in Schuster, U.S. Pat. No. D430,942, which is assigned the assignee of the present application. The Schuster landscape lightpost includes a main post, a cap and a fin assembly.

Arlington Industries, Inc of Scranton, Pa., markets a landscape lightpost having a substantially square profile. The Arlington landscape lightpost has an aperture in one side thereof that provides access to a substantially enclosed region where electrical connections are made. A cover plate is attached to the lightpost to cover the aperture and thereby restrict access to the area where the electrical connections are made.

None of the prior art landscape lightpost designs provides a cylindrical post with a substantially enclosed wire compartment, which protects the wire connections from exposure to the environmental elements, provides a means for securely connecting a wire or cabling system and provides easy access to the wire connections.

SUMMARY OF THE INVENTION

The present invention is a landscape lightpost for supporting a light fixture at a desired location above ground surface. The landscape lightpost generally includes a main post, a cap and a separator plate and stabilizer fins.

The separator plate is designed for placement over an end of the main post. The cap has a recess formed therein. The recess is adapted to receive the end of the main post over which the separator plate is placed.

Attaching the cap to the main post retains the separator plate in a fixed position so that the cap and the separator plate define a substantially enclosed region where connections between the light fixture and a feed wire are made.

BRIEF DESCRIPTION OF THE DRAWINGS

FIG. 8 is a top view of a separator plate for the landscape lightpost;

FIG. 9 is a side view of the separator plate;

FIG. 10 is a bottom view of the separator plate;

FIG. 11 is an elevational view of a grounding bond wire; and

FIG. 12 is an elevational view of a ground screw;

DETAILED DESCRIPTION OF THE PREFERRED EMBODIMENTS

A landscape lightpost 10 in accordance with the invention generally includes a main post 20, a cap 22, and a separator plate 24. When assembled, the landscape lightpost 10 provides a substantially enclosed region where electrical connections are made to thereby protect the electrical connections from exposure to environmental elements.

Figure 5:
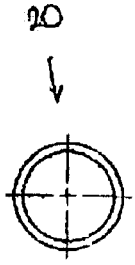
FIG. 5 is a top view of the main post.
Figure 4:
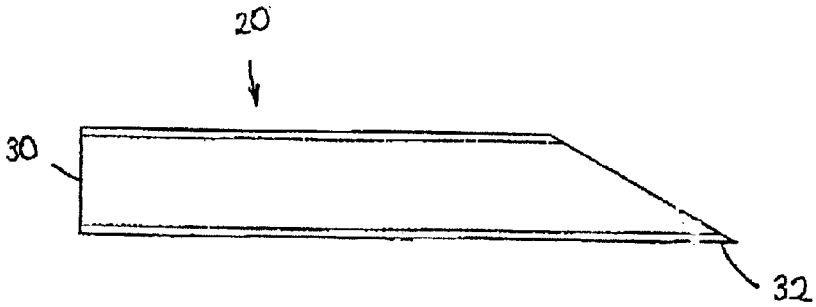
FIG. 4 is a side, sectional view of a main post for the landscape lightpost.

With particular reference to FIGS. 4 and 5, the main post 20 is a substantially cylindrical tube, as illustrated in FIGS. 4 and 5. The main post 20 can be fabricated from polyvinyl chloride and preferably has a length of about 19 inches and an outer diameter of about 3 inches. However, a person of ordinary skill in the art will appreciate that main post 20 may be fabricated with alternate shapes, materials and sizes using the concepts of the present invention.

The main post 20 has an upper end 30 and a lower end 32. The upper end 30 presents structure defining an operably oriented substantially perpendicular to the main longitudinal axis of the main post 20. The lower end 32 is preferably angled to facilitate inserting the main post 20 into a ground surface (not shown). The angle of the slant cut 35 is less than 45 degrees, preferably less than 25 degrees and most preferably between 15 and 20 degrees. Orienting the lower end 32 at an angle also facilitates feeding wires into the main post 20 and for wiring multiple lighting fixtures in series because the angled bottom allows cable or conduit to easily enter at different depths thereby avoiding wire congestion.

Figure 6:
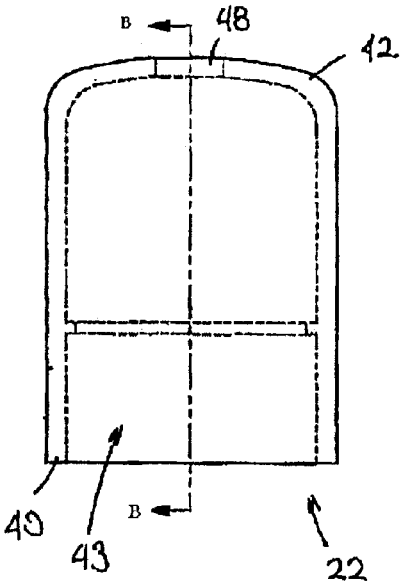
FIG. 6 is a side view of a cap for the landscape lightpost with phantom lines depicting interior structure.
Figure 7:
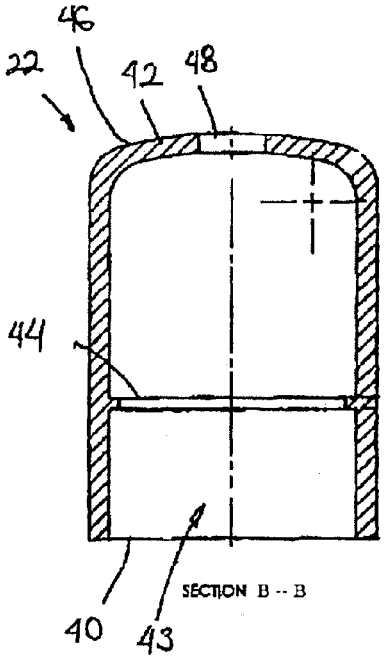
FIG. 7 is a sectional view of the cap taken along a line B—B in FIG. 6.

The cap 22 has an open end 40 and a substantially closed end 42, as illustrated in FIGS. 6–7. The open end 40 has a cavity 43 formed therein. The open end 40 has an inner diameter that is approximately the same as an outer diameter of the main post 20 to facilitate inserting the main post 20 into the cap 22. The cap 22 can preferably be made in two material versions: fabricated out of polyvinyl chloride and fabricated out of zinc die case steel or other metallic material. The landscape lightpost is shatter resistant to denting or cracking typically caused by landscape maintenance equipment. It is also corrosion and UV (ultraviolet) resistant and impervious to changing environmental conditions such as the extreme heat of the Southwestern summers or the brutal cold of Northeast winters.

An inwardly directed flange 44 is provided proximate the open end 40 to limit the extent that the main post 20 may be inserted into the cap 22. The inwardly directed flange 44 also retains the separator plate 24 in a stationary position when the plug is attached to the main post 20. It will be appreciated that the inwardly directed flange 44 may comprise a plurality of spaced abutment surfaces extending radially inwardly from the internal surface 45 of the cavity 43 and adapted to abut the upper end of the main post 20 thereby limiting the extent of insertion of the main post into the cap 22 as illustrated in FIG. 14.

The closed end 42 preferably has a curved or angled surface 46 that forms a crown and reduces the likelihood that water or other substances will accumulate on the closed end 42. An aperture 48 is provided on the closed end 42. The aperture 48 is designed to receive a threaded nipple 112 (illustrated in FIG. 13) that extends from a light fixture (not shown) to facilitate attaching the light fixture to the cap 22. The aperture 48 may include a threaded boss 114, shown in FIG. 13, to facilitate attaching the light fixture to the cap 22. The threaded nipple 112 is, for example, a ½" trade size conduit nipple. The crown may be slanted for example, at 20 degrees, so as to virtually eliminate water pooling or leakage into the interior of the landscape lightpost.

The separator plate 24 is provided with an outer profile that is preferably substantially the same as the main post 20, as illustrated in FIGS. 1–3 and 8–10. A lower surface 52 of the separator plate 24 preferably has a channel 54 formed therein that extends around the edge of the separator plate 24. The channel 54 permits the separator plate 24 to partially seat in the main post 20 to retain the separator plate 24 in a stationary position with respect to the main post 20 when assembling the landscape lightpost 10. The separator plate 24, similar to the cap 22, can preferably be made in two material versions: fabricated out of polyvinyl chloride and fabricated out of zinc die cast steel or other metallic material.

The separator plate 24 includes at least one aperture 56 adapted to receive a cable connector device. However, to accommodate multiple electrical circuits, or to allow an electrician to wire multiple light fixtures in series, the separator plate 24 includes two ½ inch diameter apertures: one aperture 56 that is manufactured open and another aperture 57A that is manufactured closed, but with perforations 57B which enable the aperture to be knocked out (opened) by the installer (the closure material commonly known as knockouts). The intended purpose of apertures 56 and 57A is to allow the installer to extend a cable connector device through the apertures. The separator plate 24 includes a 10/32 inch tapped hole 58 to accommodate a grounding bond wire 59 or 10/32 inch ground screw 60.

Figure 2:
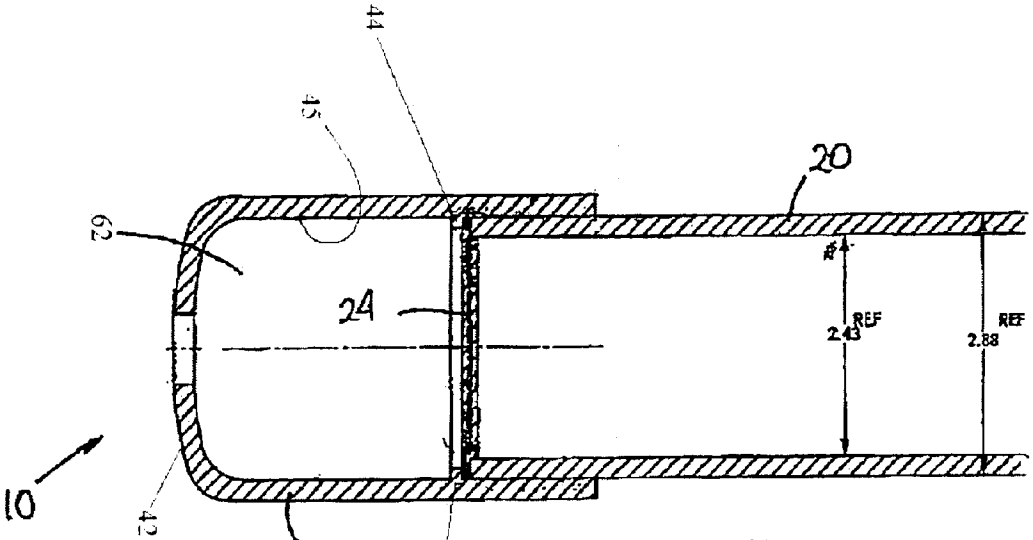
FIG. 2 is a sectional view of the landscape lightpost taken along a line A—A in FIG. 1.
Figure 1:
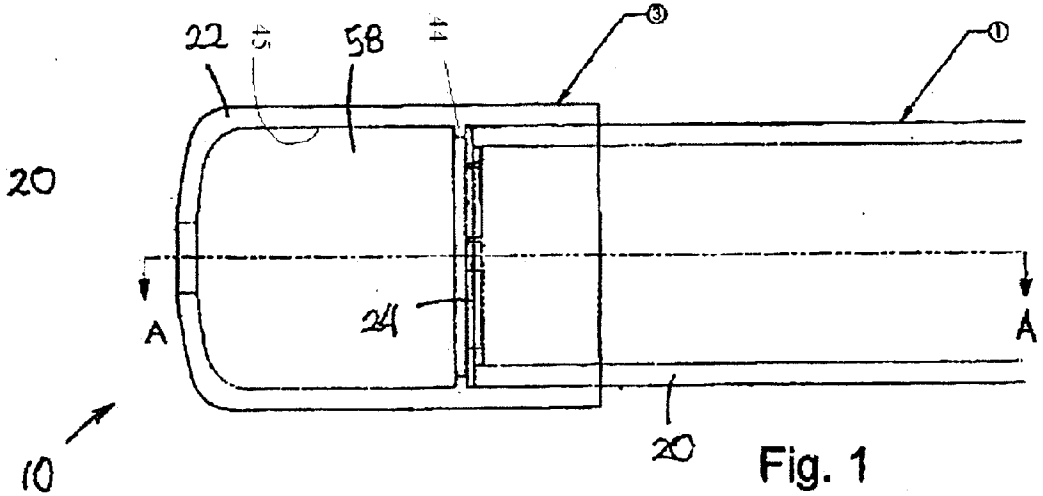
FIG. 1 is a side view of a landscape lightpost according to the present invention.
Figure 3:
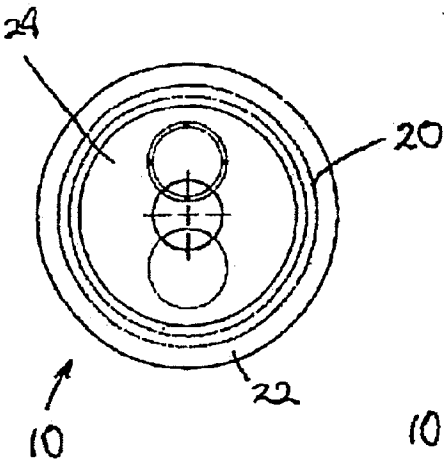
FIG. 3 is a top view of the landscape lightpost with phantom lines depicting interior structure.

The cap 22 and the separator plate 24 thereby define a substantially enclosed region 62, as illustrated in FIGS. 1–2. The size of the substantially enclosed region 62 is selected based upon the size and number of wires that must be connected in the substantially enclosed region 62. The substantially enclosed region 62 has a volume of greater than 5 cubic inches, preferably between 10 and 19 cubic inches and most preferably about 13½ cubic inches. The most preferred configuration is particularly suited where six 12 gauge wires must be connected within the substantially enclosed region 62.

Figure 13:
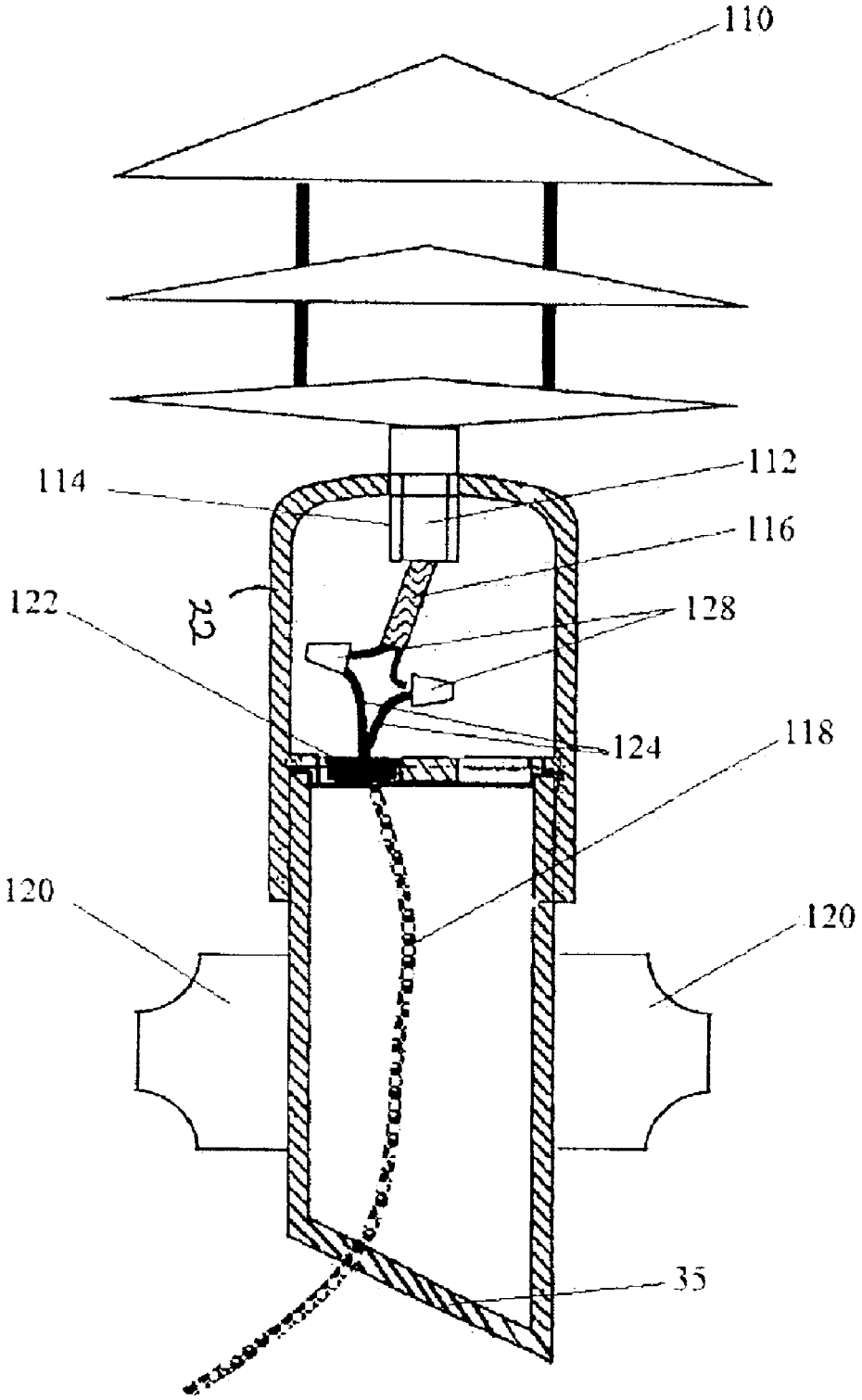
FIG. 13 is a sectional view of the landscape lightpost taken along a line A—A in FIG. 1, and including an electric lamp with lamp connecting wires interconnected to electrical and grounding wires.

The landscape lightpost 10 may also include a fin assembly 120, as shown in FIG. 13, attached to the main post 20 proximate to the lower end 32 to facilitate supporting the landscape lightpost 10 in the ground surface, such as is illustrated in Schuster, U.S. Pat. No. D430,942 and incorporated herein by reference. The fin assembly can include at least one, and preferably four, fins that extend outwardly from the main post 20. A preferred shape of the fins is illustrated in FIG. 13. The concave stabilizing design enables ground material to be easily packed around the lightpost and provides solidly anchored, in-ground support. This concave design also helps resist against heaving caused by ground freezing and thawing.

As an alternative to providing the landscape lightpost 10 as a complete unit, it is possible to provide the cap 22 and separator plate 24 for retrofitting landscape lightposts that did not include a substantially enclosed region where wire connections are made. It will be appreciated that the costs and time associated with the project are substantially reduced by not having to replace the entire landscape lightpost. The landscape lightpost may be used for permanent installation of UF line voltage cable or conduit and makes installation quick, easy, and reliable.

In operation, at least one feed 118 wire is positioned to extend from the ground surface proximate to where the landscape lightpost 10 is to be located as shown in FIG. 1B. A cable connector 122 is fastened into one or two apertures 56, 57A in the separator plate 24. An end of the feed wire is fed through the cable connector allowing adequate cable for the installer to be able to splice the cable to the conductors of the fixture. The cable connector is then securely tightened around the feed wire with an end of the feed wire 124 extending into the interior region of the cap 22. Next, a light fixture 110 is attached to the cap 22 so that lamp connecting wires 116 extend from light fixture 110 to the interior region of the cap 22. The feed wire is then attached to lamp connecting wires 116 using a desired mechanism such as a wire nut 128. This process is repeated for additional wires as necessary.

The cap 22 is placed over the upper end 30 of the main post 20 so that the upper end 30 extends into the cap 22. As discussed above, the cap 22 and the separator plate 24 thereby form a substantially enclosed region 62. One or more screws (not shown) may be used to secure the cap 22 to the main post 20.

Figure 14C:
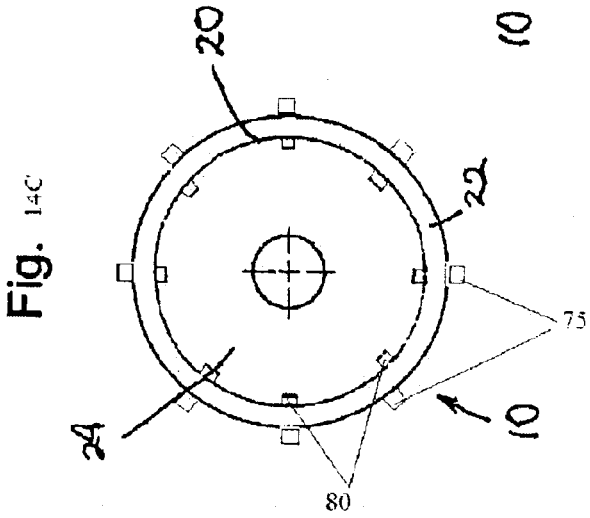
FIG. 14C is a top view of landscape lightpost of FIG. 14A.
Figure 14A:
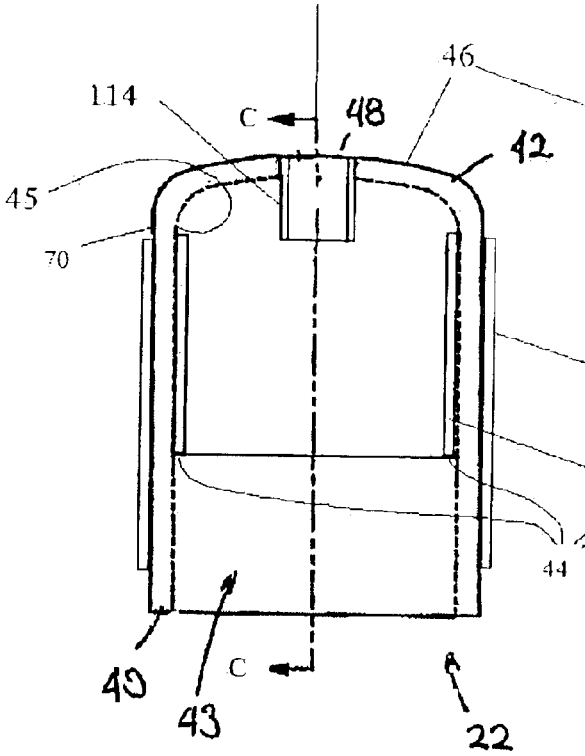
FIG. 14A illustrates a landscape lightpost with external and internal ribs, with phantom lines depicting internal structure.
Figure 14B:
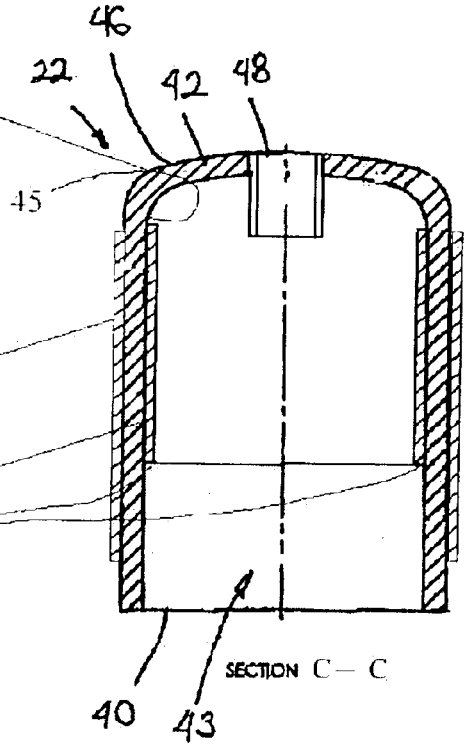
FIG. 14B is a sectional view of the landscape lightpost of FIG. 14A taken along a line C—C in FIG. 14A.

In an alternate embodiment, illustrated in FIGS. 14A, 14B and 14C, the cap 22 has an external surface 70 depending from the curved surface 46. The external surface 70 is provided with a plurality of longitudinal ribs 75 spaced at regular pitch spacings. The ribs 75 contribute to the structural rigidity of the cap 22. In a preferred embodiment, the internal surface 45 of the enclosed region 62 is also provided with a plurality of spaced longitudinal ribs 80 extending inwardly from the internal surface 45, the lower end 82 of the ribs 80 comprising abutment surfaces 84 adapted to abut the upper end of the main post 20 thereby limiting the extent of insertion of the main post into the cap 22.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A landscape lightpost apparatus for mounting an electric lamp having lamp connecting wires adjacent a ground surface, the apparatus suited to receive electrical and grounding feed wires from a region proximate the ground surface and route said wires into a substantially enclosed region for electrical interconnection with the lamp, the apparatus comprising:

a main post having a lower end, an upper end, and structure defining an internal bore for receiving electrical and grounding wires;

a cap having a cap body, an open end and a substantially closed end, the cap body and substantially closed end defining an internal cavity having a longitudinal axis and an internal surface, the internal surface further including a flange portion extending inwardly into the cavity, said flange portion oriented generally proximal the open end of said cap, the closed end of said cap including structure defining an aperture for holding an electric lamp fixture therein; and a separator plate having a first surface, an opposed second surface and a peripheral edge, the plate adapted to be closely received in the cavity with the peripheral edge of said separator plate operably contacting said internal surface, the first surface of said separator plate abutting the flange to sealingly divide the cavity into a substantially enclosed region bounded by the cap generally closed end and a second region proximal the cap open end, the second region shaped and dimensioned to slidably receive the main post, the upper end of the post abutting the second surface of the plate when the post is fitted into the second region, the plate further having structure defining an aperture adapted to receive a cable connector, the cable connector having electrical and grounding feed wires extending therefrom into the enclosed region for electrical joining with the lamp connecting wires of the electric lamp whereby the electrical connections of the cable connector to the electric lamp are protected from exposure to environmental elements.

2. The landscape lightpost of claim 1 wherein the separator plate has a channel disposed on the second surface of the separator plate adjacent to and extending around the peripheral edge of the separator plate, the channel shaped to engage the upper end of the main post.

3. The landscape lightpost of claim 1 wherein the separator plate has at least one knockout spaced from the aperture selectively removable to form an opening in the plate adapted to receive a cable connector.

4. The landscape lightpost of claim 1 wherein the separator is formed of material selected from the group consisting of polyvinyl chloride and zinc die cast steel.

5. The landscape lightpost of claim 1 wherein the separator is formed of a metallic material and having a threaded hole spaced apart from the aperture.

6. The landscape lightpost of claim 1 wherein the cap is formed of material selected from the group consisting of polyvinyl chloride and zinc die cast steel.

7. The landscape lightpost of claim 1 wherein the cap is formed of a metallic material.

8. The landscape lightpost of claim 1 wherein the closed end of the cap has an arcuate external surface forming a crown to urge matter disposed on the external surface is caused to move downwardly towards the ground surface urged by the force of gravity.

9. The landscape lightpost of claim 1 wherein the cap has an external surface, a plurality of ribs arranged spaced apart from one another at regular pitch spacings on the surface.

10. The landscape lightpost of claim 1 in which the post includes a first portion adapted to be disposed above ground and a second portion adapted to be disposed below ground.

11. The landscape lightpost of claim 1 wherein the flange portion is comprised of a plurality of longitudinal ribs having a lower end surface proximate the open end of the cap and arranged spaced apart from one another, disposed on and extending inwardly into the cavity from the internal surface of said cavity, said lower end surfaces of said ribs providing an abutment for the first surface of the separator plate.

12. The landscape lightpost of claim 11 in which the bottom rim presents a slant cut.

13. The landscape lightpost of claim 11 in which the second portion includes a plurality of planar surfaces disposed on and extending outwardly from the post.

14. A landscape lightpost apparatus for mounting an electric lamp fixture having lamp connecting wires, said apparatus adapted to receive and route electrical and grounding feed wires into an environmentally protected enclosure for making electrical connections with said lamp connecting wires, said apparatus comprising:

a cylindrical main post having a lower end, an upper end, and a structure defining an axial bore;

a tubular cap having an open end and a closed end, said tubular cap enclosing a cavity with an internal surface, said internal surface of said cavity provided with an abutment surface extending radially inwardly, the closed end having a structure defining an aperture adapted to receive said electric lamp fixture; and a separator plate having a peripheral edge, said separator plate adapted to be received in said cavity, said peripheral edge operably contacting said internal surface, said separator plate further having a first surface and an opposed second surface, said first surface of said separator plate abutting said abutment surface to divide the cavity into a substantially enclosed region bounded by said closed end of said tubular cap and a second region proximate said open end of said tubular cap, said second region shaped and dimensioned to slidably receive said post, said second surface of said separator plate adapted to abut against said upper end of said main post to locate the main post in place with respect to said closed end of said tubular cap when said post is fitted into said second region, said separator plate further including structure defining at least one aperture, said aperture adapted to receive said cable connector.

15. The landscape lightpost of claim 14 wherein said second surface of said separator plate is provided with a channel disposed around the peripheral edge of said separator plate and extending radially inwards from said peripheral edge, said channel operatively associated with said main post to maintain said separator plate in a stationary relationship with the main post during electrical joining of the electrical and grounding feed wires to said lamp connecting wires of said lamp fixture.

16. The landscape lightpost of claim 14 wherein the separator plate has at least one knockout spaced from the aperture, said knockout removable to form an opening in the plate adapted to receive a cable connector.

17. The landscape lightpost of claim 14 wherein the separator is formed of material selected from the group consisting of polyvinyl chloride and zinc die cast steel.

18. The landscape lightpost of claim 14 wherein the separator is formed of a metallic material and having a threaded hole spaced apart from the aperture.

19. The landscape lightpost of claim 14 wherein the cap is formed of material selected from the group consisting of polyvinyl chloride and zinc die cast steel.

20. The landscape lightpost of claim 14 wherein the cap is formed of a metallic material.

21. The landscape lightpost of claim 14 wherein the closed end of the cap has a curved external surface extending in sloping fashion from said aperture of said tubular cap to form a crown which causes gravitational descent of matter disposed on said surface.

22. The landscape lightpost of claim 14 wherein the cap has an external surface, a portion of said external surface provided with a plurality of longitudinal ribs spaced apart from one another at substantially regular pitch spacings.

23. The landscape lightpost of claim 14 wherein the structure defining said aperture in said closed end of said tubular cap comprises a threaded cylindrical boss extending from said closed end of said cap inwardly into said substantially enclosed region of said cap.

24. The landscape lightpost of claim 14 wherein said internal surface of said cavity is provided with a plurality of circumferentially spaced longitudinal ribs, said ribs extending radially inward from said internal surface and having a bottom surface proximate the open end of said tubular cap.

25. The landscape lightpost of claim 24 wherein said abutment surface of said internal surface of said tubular cap is comprised of said bottom surfaces of said ribs.

26. The landscape lightpost of claim 14 in which the post includes a first portion disposed above ground and a second portion disposed below ground.

27. The landscape lightpost of claim 26 in which the bottom rim comprises a slant cut.

28. The landscape lightpost of claim 26 in which the second portion includes a plurality of planar fin surfaces extending outwardly from said post.

29. The landscape lightpost of claim 26 wherein the aperture in said closed end of said cap is threaded to operably receive said electric lamp fixture.

30. A landscape lightpost apparatus securable to a ground surface, said apparatus comprising:

an electric lamp fixture having lamp connecting wires;

a main post having a lower end, an upper end, and structure defining an internal bore for receiving electrical and grounding feed wires from adjacent said ground surface;

a cap having a cap body, an open end and a substantially closed end, the cap body and substantially closed end defining an internal cavity having a longitudinal axis and an internal surface, the internal surface further including a flange portion extending inwardly into the cavity, said flange portion oriented generally proximal the open end of said cap, the closed end of said cap including structure defining an aperture for removably receiving said electric lamp fixture therein; and a separator plate having a first surface, an opposed second surface and a peripheral edge, the plate adapted to be closely received in the cavity with the peripheral edge of said separator plate operably contacting said internal surface, the first surface of said separator plate abutting the flange to sealingly divide the cavity into a substantially enclosed region bounded by the cap generally closed end and a second region proximal the cap open end, the second region shaped and dimensioned to slidably receive the main post, the upper end of the post abutting the second surface of the plate when the post is fitted into the second region, the plate further having structure defining an aperture adapted to receive a cable connector, the cable connector having electrical and grounding feed wires extending therefrom into the enclosed region for electrical joining with the lamp connecting wires of the electric lamp whereby the electrical connections of the cable connector to said electric lamp are protected from exposure to environmental elements.

31. The landscape lightpost of claim 30 wherein the separator plate has a channel disposed on the second surface of the separator plate adjacent to and extending around the peripheral edge of the separator plate, the channel shaped to abut the upper end of the main post to maintain the separator plate in a stationary relationship with the main post during electrical joining of the electrical and grounding feed wires to the lamp fixture.

32. The landscape lightpost of claim 30 wherein the separator plate has at least one knockout spaced from the aperture removable to form an opening in the plate adapted to receive a cable connector.

33. The landscape lightpost of claim 30 wherein the separator is formed of material selected from the group consisting of polyvinyl chloride and zinc die cast steel.

34. The landscape lightpost of claim 30 wherein the separator is formed of a metallic material and having a threaded hole spaced apart from the aperture.

35. The landscape lightpost of claim 30 wherein the cap is formed of material selected from the group consisting of polyvinyl chloride and zinc die cast steel.

36. The landscape lightpost of claim 30 wherein the cap is formed of a metallic material.

37. The landscape lightpost of claim 30 wherein the flange portion is comprised of a plurality of longitudinal ribs having a lower end surface proximate the open end of the cap and arranged spaced apart from one another, disposed on and extending inwardly into the cavity from the internal surface of said cavity, said lower end surfaces of said ribs providing an abutment for the first surface of the separator plate.

38. The landscape lightpost of claim 30 wherein the cap has an external surface, a plurality of ribs arranged spaced apart from one another at regular pitch spacings on the surface.

39. The landscape lightpost of claim 30 in which the post includes a first portion disposed above ground and a second portion disposed below ground.

40. The landscape lightpost of claim 30 wherein the closed end of the cap has an arcuate external surface forming a crown to urge matter disposed on the external surface is caused to move downwardly towards the ground surface urged by the force of gravity.

41. The landscape lightpost of claim 40 in which the bottom rim comprises a slant cut.

42. The landscape lightpost of claim 40 in which the second portion includes a plurality of planar surfaces disposed on and extending outwardly from the post.

43. A landscape lightpost apparatus for mounting an electric lamp fixture having lamp connecting wires, said apparatus adapted to receive and route electrical and grounding feed wires into an environmentally protected enclosure for making electrical connections with said lamp connecting wires, said apparatus comprising:

a cap having a first substantially closed end, a second open end and a cavity therebetween;

means connected to said closed end of said cap for mounting said lamp fixture on said cap with said lamp connecting wires of said lamp fixture received in said cavity of said cap;

a main post, having a first end protruding from a ground surface and slidably received within said cavity of said cap through said open end of said cap, for receiving and routing electrical and grounding feed wires from a region adjacent said ground surface;

a separator plate, slidably received within said cavity of said cap, for providing a conduit for receiving said feed wires routed through said post means and guiding them towards said lamp fixture;

means attached to said conduit in said separator plate for securing said feed wires to said separator plate;

means projecting from said cavity of said cap for providing abutment surfaces for said separator plate to limit sliding movement of said separator plate within said cavity thereby creating a substantially closed environmentally protected enclosure which includes the closed end; and means provided on said separator plate for abutting said first end of said post means to limit travel of said post means within said cavity of said cap whereby said cap is supported by said post means.

* * * * *